US008769723B1

(12) United States Patent
Ilges et al.

(10) Patent No.: US 8,769,723 B1
(45) Date of Patent: Jul. 8, 2014

(54) HAT WITH EAR WARMER

(71) Applicants: Loretta Ilges, St. Louis, MO (US); Tina Witte, St. Louis, MO (US)

(72) Inventors: Loretta Ilges, St. Louis, MO (US); Tina Witte, St. Louis, MO (US)

( * ) Notice: Subject to any disclaimer, the term of this patent is extended or adjusted under 35 U.S.C. 154(b) by 0 days.

(21) Appl. No.: 14/200,451

(22) Filed: Mar. 7, 2014

Related U.S. Application Data

(60) Provisional application No. 61/794,660, filed on Mar. 15, 2013.

(51) Int. Cl.
*A42B 1/06* (2006.01)
*A42B 1/02* (2006.01)

(52) U.S. Cl.
CPC ..... *A42B 1/02* (2013.01)
USPC ..... 2/172

(58) Field of Classification Search
USPC ..... 2/171, 172, 173, 202, 203, 205, 208, 2/174, 9, 209, 423, 209.12
See application file for complete search history.

(56) References Cited

U.S. PATENT DOCUMENTS

| | | | | |
|---|---|---|---|---|
| 723,946 | A | | 3/1903 | Tobias |
| 1,274,842 | A | | 8/1918 | Basch |
| D92,566 | S | | 6/1934 | Abraham |
| 2,089,427 | A | | 12/1936 | Rose |
| 2,149,121 | A | | 2/1939 | Kronenberger |
| 2,159,609 | A | | 5/1939 | Wengen |
| 2,444,251 | A | | 8/1946 | Goldman |
| 2,442,825 | A | | 6/1948 | Rabushka |
| 2,572,746 | A | | 10/1951 | Mougle |
| 2,671,221 | A | | 3/1954 | Triplett |
| 2,701,365 | A | | 2/1955 | Funk |
| 2,704,367 | A | | 3/1955 | Gellman |
| 2,844,820 | A | | 7/1958 | Austin |
| 3,358,292 | A | | 12/1967 | Bonk |
| 3,497,874 | A | | 3/1970 | Molitoris |
| 4,391,000 | A | * | 7/1983 | Lonnstedt ..... 2/423 |
| 4,486,903 | A | | 12/1984 | Krystal |
| 4,551,859 | A | | 11/1985 | Gerhardt |
| 4,951,319 | A | | 8/1990 | Phillips |
| 4,982,451 | A | | 1/1991 | Graham |
| 5,038,412 | A | | 8/1991 | Cionni |
| 5,092,667 | A | | 3/1992 | Bagley |
| 5,835,609 | A | | 11/1998 | Legette |
| 5,933,871 | A | * | 8/1999 | Kraft ..... 2/209.13 |
| 6,115,843 | A | | 9/2000 | Travalgia |
| D518,943 | S | | 4/2006 | Levinson |
| 7,360,258 | B2 | | 4/2008 | Jaye |
| D577,879 | S | | 10/2008 | Jones |
| D624,286 | S | | 9/2010 | Hall |
| 7,962,970 | B2 | | 6/2011 | Le Gette |
| 7,979,921 | B2 | | 7/2011 | Cotutsca |
| D654,253 | S | | 2/2012 | Belschner |
| 8,204,265 | B2 | | 6/2012 | Siskin |
| D668,428 | S | | 10/2012 | Shenker |
| 2012/0124715 | A1 | | 5/2012 | Le Gette |

* cited by examiner

*Primary Examiner* — Tejash Patel
(74) *Attorney, Agent, or Firm* — CreatiVenture Law; Linda L. Lewis

(57) ABSTRACT

A knit hat that has sleeve, wherein the sleeve encloses an ear warmer having a frame with a band and a first and second ear portions that are at least partially covered by the hat when worn. The hat is formed of a thread yarn material and the hat is provided with a shape suitable for securing the hat around a person's head so as to conform to the contours of the head to substantially minimize gaps between the hat and the head. Unexpectedly, the band of the ear warmer within the sleeve of the hat provides tension to the hat that causes it to hug the back of the head. At the same time, the first and second ear portions keep the ears of the wearer securely covered.

18 Claims, 20 Drawing Sheets

REPLACEMENT SHEET
App #: 14200451
Filed: March 7, 2014

HAT WITH EAR WARMER

CROSS-REFERENCE TO RELATED APPLICATIONS

This application claims priority from U.S. Provisional Patent Application No. 61/794,660 filed Mar. 15, 2013 which is hereby incorporated by reference.

STATEMENT REGARDING FEDERALLY SPONSORED RESEARCH

Not Applicable.

APPENDIX

Not Applicable.

BACKGROUND OF THE INVENTION

1. Field of the Invention

The present invention relates to headgear and, more particularly, to a hat that provides ear warmers and a tensioning device that causes the hat to conform snuggly to the head, particularly the ears and the back of the head, thereby providing more warmth and a more secure covering than prior art devices.

2. Related Art

Currently, hats or headgear are worn for a variety of purposes. Some hats are purely ornamental, some have origins in deeply-rooted religious beliefs, some have a purely utilitarian purpose, and some combine these aspects.

One purpose of headgear is for protection from environmental elements, including cold air, wind, and snow or precipitation. In order to protect someone from these or other elements, the headgear should keep the element from reaching the wearer's body and head.

Often, winter hats are loose-knit from fibrous material such as wool, cotton, or a synthetic fiber. The fiber and the knit pattern provide the hat with a certain amount of elasticity so that the hat is stretched somewhat through the act of putting the hat on one's head, and the hat will then contract and conform to the shape of the wearer's head.

Typically, hats used for protection against the weather are used in conjunction with other apparel items. Specifically, a person will wear a hat, and a coat, a scarf and ear warmers. Overlapping the items, such as with an ear warmer over a hat or a hat over an ear warmer fails to provide the optimum coverage. A knit hat without ear warmers fails to completely cover the ears, as the elastic knit material creeps and pulls up and away from the ears.

A hat's utility is dependent on its ability to preventing cold air to reach the wearer's head, particularly at the hat's opening. For instance, a person who wears eyeglasses may pull a hat down on their head only to have gaps where the temples of the eyeglasses hold the hat away from the head, thereby allowing cold air to pass to the person's head.

The same issue is present for someone wearing a hat where the person has long hair. If the hair is allowed to drape down the neck and back, the combination of elasticity of the hat and of the fact that the hair provides a slick surface over which the hat is pulled causes the hat to creep up and off of the head. This reduces the effectiveness of the hat to keep the person warm.

Accordingly, there has been a need for a new and improved hat or headgear for protecting a person's head from environmental elements.

Ear warmers have been made that grip the back of the head and cover the ears securely. There is no suitable way to combine the use of these ear warmers with a knit hat to warmly and securely cover the head.

The present invention has combined the effectiveness of the ear warmers with the warmth and effectiveness of a knit hat, in a combination that provides the unexpected result of adding tension to the back of the hat so that the hat does not creep up and expose the neck, the back of the head or the ears. There is no prior art device that does what the present invention does.

Examples of known prior art devices are described in U.S. Pat. Nos. 2,089,427, 2,444,251, 5,038,412, 7,212,645, 7,222,373 and 7,650,649. None of the listed references disclose the claimed combination of hat with ear warmers. U.S. Pat. No. 7,962,970 and US 2012/0124715 disclose prior art ear warmers which are not attached to a hat.

SUMMARY OF THE INVENTION

In accordance with one aspect of the present invention, a knit hat that has a hem at the back and the bottom of the hat with a sleeve, wherein the sleeve encloses the ear warmer band and the first and second ear portions are at least partially covered by the hat when worn. The hat is formed of a thread yarn material suitable for protection from cold air, the yarn being in a construction pattern so that the hat stretches and contracts upon application and release of force upon the hat, and the hat is provided with a shape suitable for securing the hat around a person's head so as to conform to the contours of the head to substantially minimize gaps between the hat and the head. Unexpectedly, the band of the ear warmer within the sleeve of the hat provides tension to the hat that causes it to hug the back of the head. At the same time, the first and second ear portions keep the ears of the wearer securely covered Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings. The drawings constitute a part of this specification and include exemplary embodiments of the invention, which may be embodied in various forms. It is to be understood that in some instances, various aspects of the invention may be shown exaggerated or enlarged to facilitate an understanding of the invention; therefore the drawings are not necessarily to scale. In addition, in the embodiments depicted herein, like reference numerals in the various drawings refer to identical or near identical structural elements.

DETAILED DESCRIPTION OF THE PREFERRED EMBODIMENTS

Figure 1:
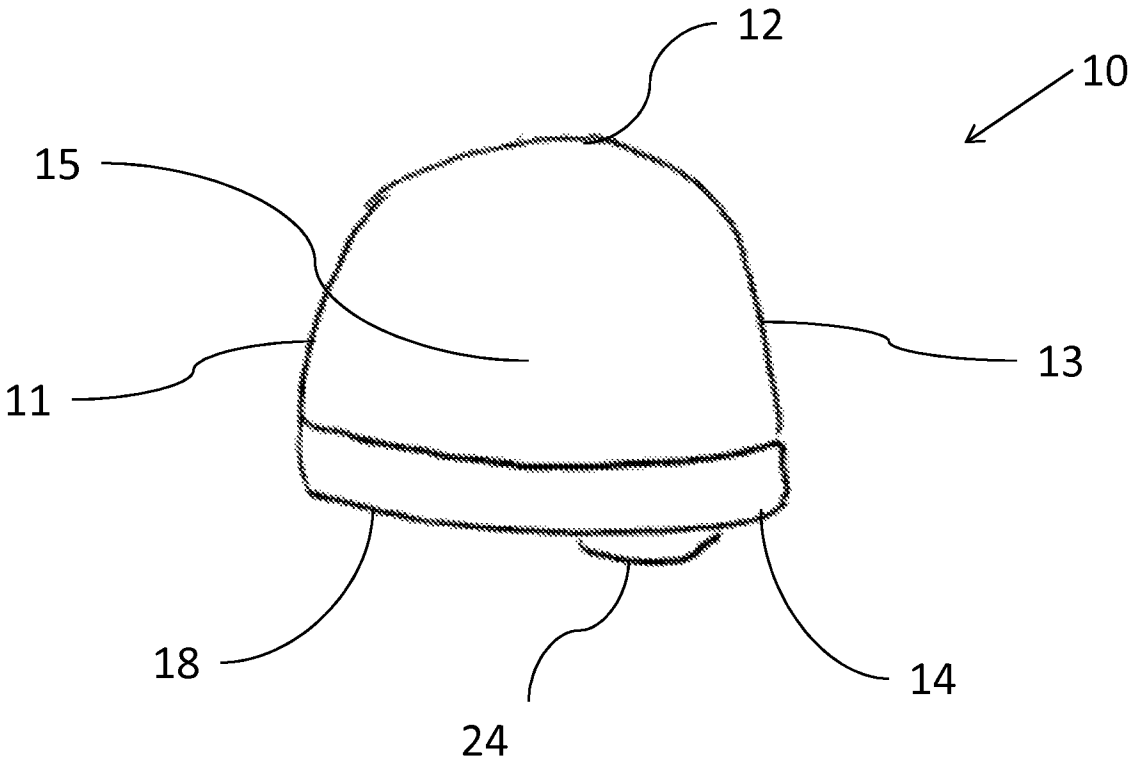
FIG. 1 is a side schematic view of an first exemplary embodiment of a hat of the present invention.

The following description of the preferred embodiment(s) is merely exemplary in nature and is in no way intended to limit the invention, its application, or uses.

Referring to the FIGS. 1-4, hat 10 has a top 12, a bottom edge 14, and a body material 16 between, as are commonly known for hats. Hat 10 furthermore has a front 11, a back 13 and sides 15. In the preferred embodiment, the hat 10 is made of a thread in the form of a yarn, such as wool, cotton, or synthetic yarn, for instance acrylic. In the preferred embodiment, the thread is knit in a loose knit-pattern such that the material forming the body material 16 may be stretched in one or more directions when force is applied to the hat 10, and such that the material tends to return to its natural shape when the force is relaxed or removed, as is also known for knit hats such as winter hats, commonly referred to as ski hats. Preferably, the material is a thread yarn material suitable for protection from cold air that has a construction pattern for the yarn that stretches and contracts upon application and release. More preferably, the hat is a shape suitable for securing the hat around a person's head so as to conform to the contours of the head to substantially minimize gaps between the hat and the head.

Figure 2:
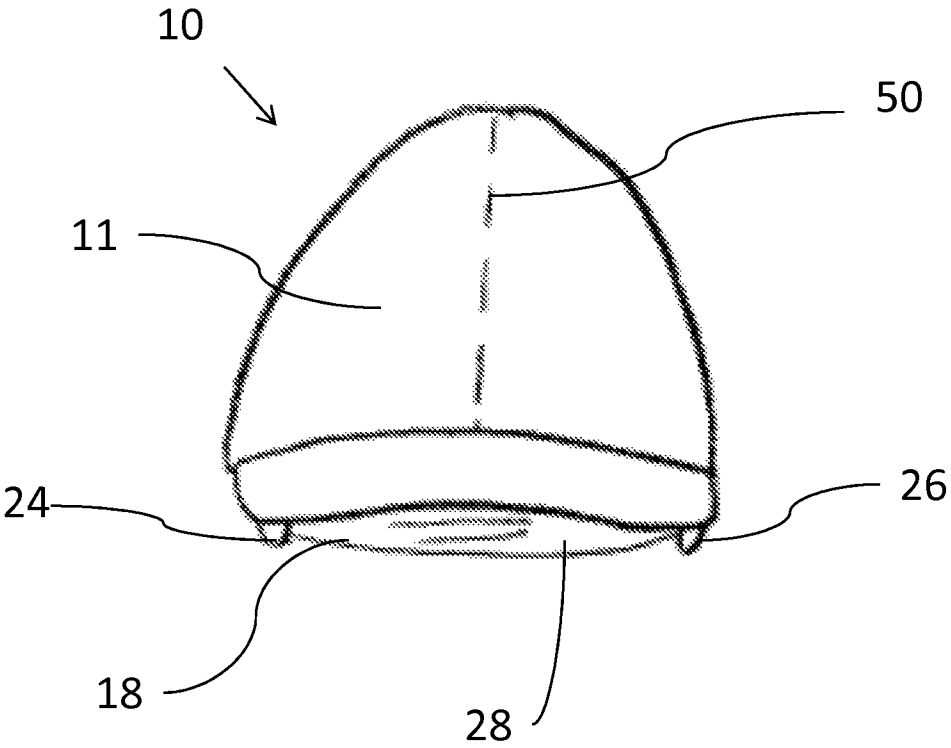
FIG. 2 is a front schematic view of a second exemplary embodiment of a hat of the present invention.

As can be seen in FIG. 2, the hat 10 optionally includes a center seam 50. Often, knit caps are made of several panels, or may be made of a single panel that has a seam, such as center seam 50 for holding the hat 10 together.

Figure 7:
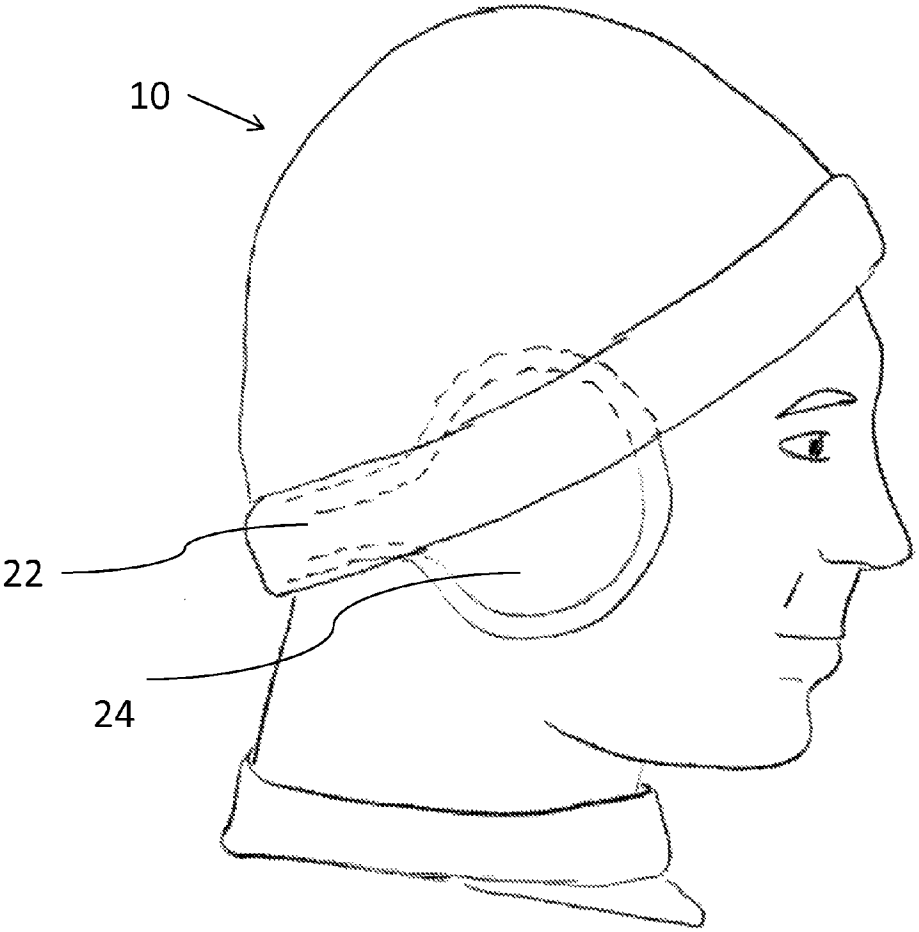
FIG. 7 is a side schematic view of a wearer using the hat of the present invention.
Figure 8:
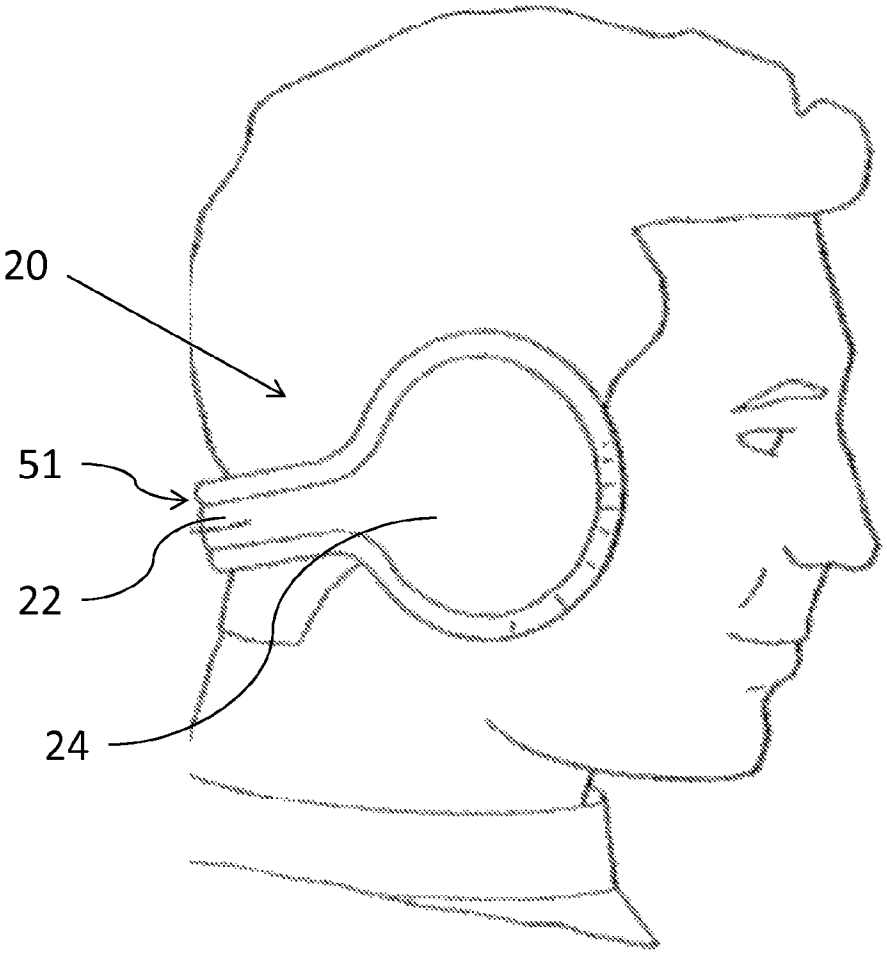
Figure 8 Prior Art
FIG. 8 is a schematic view of a wearer using prior art ear warmers.

As can be seen in FIGS. 7 and 8, the present invention is an improvement over the prior art ear warmers 20, which have a frame 51 with a band 22, a first ear portion 24 and a second ear portion 26. Examples of such ear warmers are disclosed in U.S. Pat. Nos. 7,962,970, 7,212,645, 7,222,373 and 7,650,649, which are hereby incorporated by reference. The ear warmer 20 comprises a frame 51 with a band portion 22 and an ear portion 24. The frame 51 has an inward bias which, when worn, causes it to hug the head of the user. The ear portion includes an inner side 52 disposed adjacent a head of a user when the ear warmer is worn by a user. In one embodiment, the ear portion is curved toward the inner side of the ear portion. In one embodiment, the ear portion is configured to flex when the ear warmer is disposed on a head of a user. The ear warmer 20 is configured to extend around a back of the head of the user.

Figure 18:
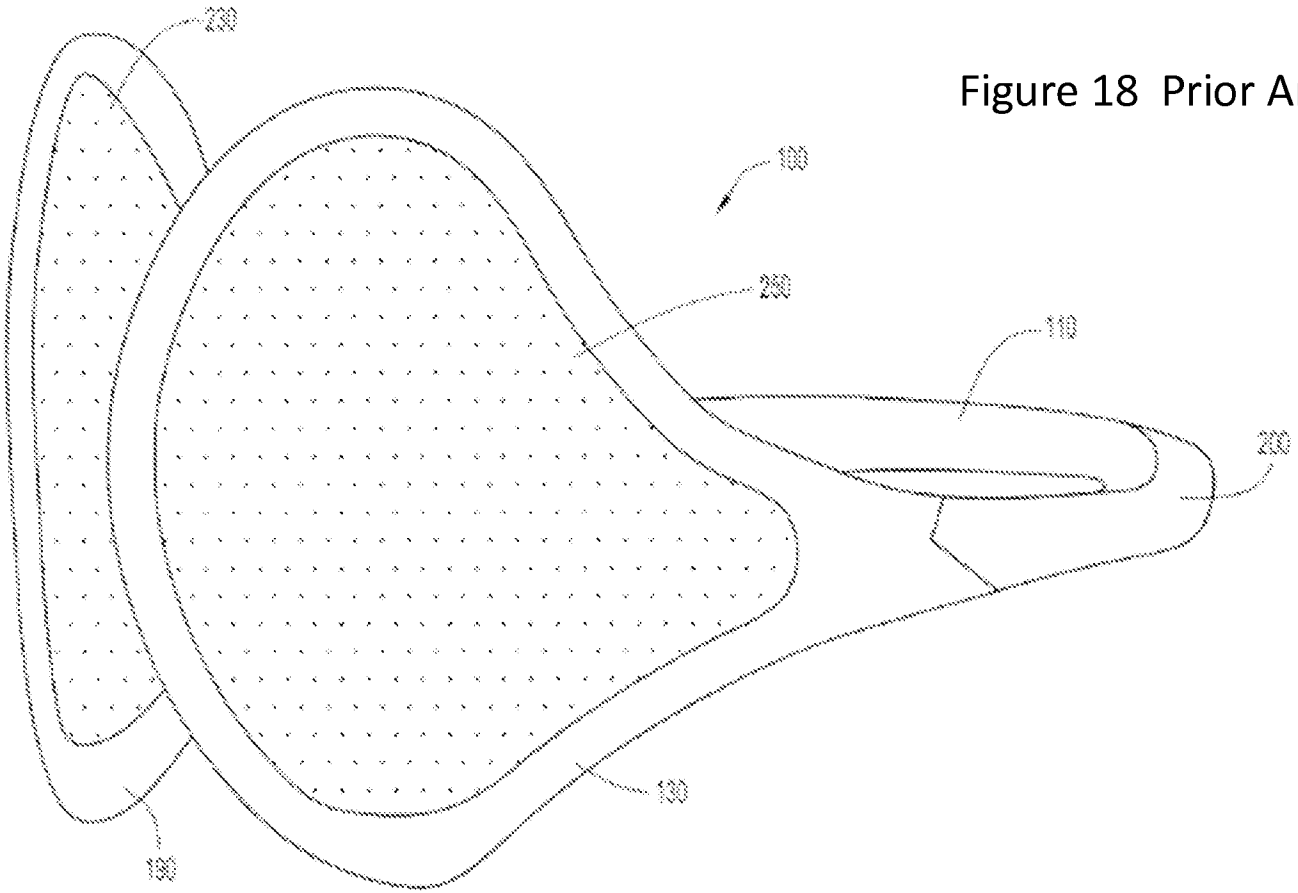
Figure 18 Prior Art
FIG. 18 is a perspective view of a prior art ear warmer in an expanded configuration.

FIG. 18 shows a prior art ear warmer having a first ear portion 130, a second ear portion 190, fabric members 230, 250, band 200 and frame 110.

Figure 19:
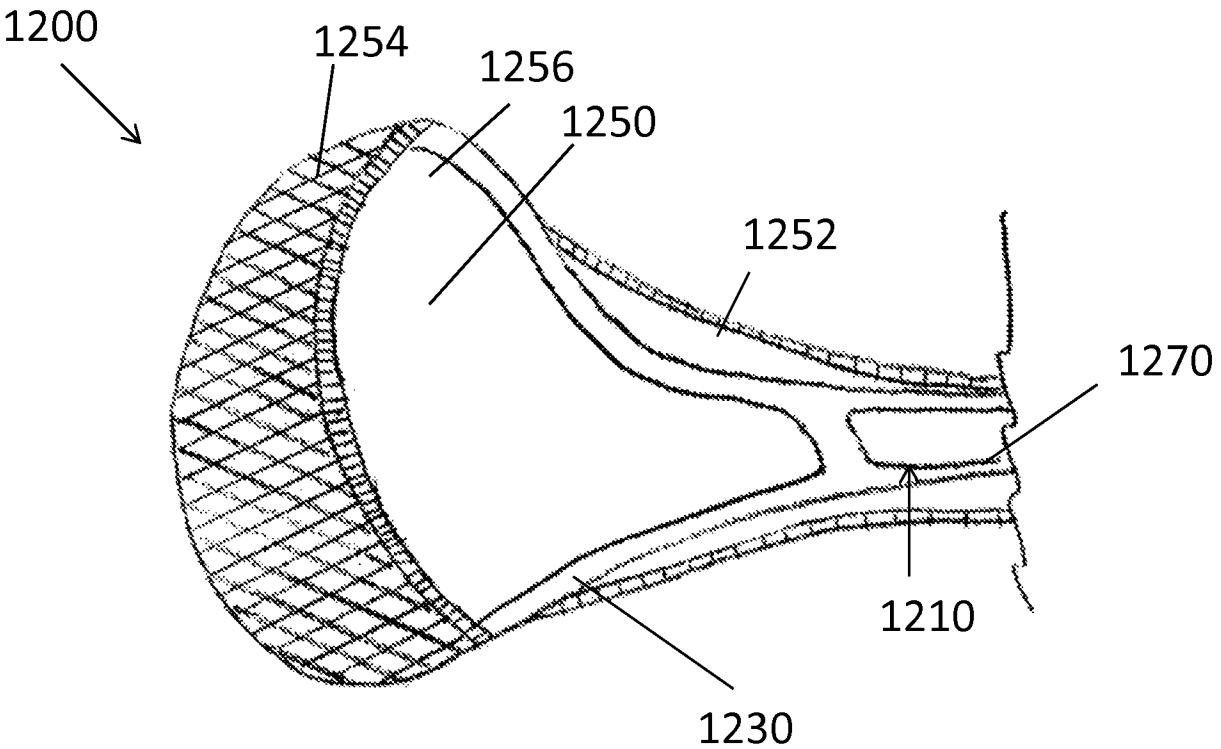
Figure 19 Prior Art
FIG. 19 is a perspective view of an inner portion of a prior art ear warmer.

FIG. 19 shows an inner side of ear portion of prior art ear warmer 1200. The ear portion 1240 has the fabric member 1250 which has an inner-side portion 1252 and an outer-side portion 1254. The inner-side portion 1252 of the fabric member 1250 corresponds to both ear portions 1230 of the frame 1210 and the band portion 1270 of the frame 1210. In this embodiment, the outer-side portion 1254 of the fabric member 1250 can be extended over the distal end of the ear portions 1230 of the frame 1210. Thus, the distal end of the ear portions 1230 of the frame 1210 can be retained in a receptacle 1256 formed by the inner-side portion 1252 and the outer-side portion 1254 of the fabric member 1230. The ears of the wearer are cupped by the ear portion of the frame. The outer-side portion 1252 of the fabric member 1250 can be made of, for example, an elastic fabric that allows the fabric member 1250 to be stretched over the distal end of the ear portions 1230 of the frame 1210 to insert and remove the frame 1210 from the fabric member 1250.

The ear warmers 20 do not provide a warm cover for the head. If the ear warmers 20 are worn under a hat 10, the hat 10 is lifted out from the head of the wearer, particularly the bottom back portion of the hat 10. If the ear warmers 20 are worn over a hat 10, the ear warmers 20 are lifted out from the ears.

Figure 9A:
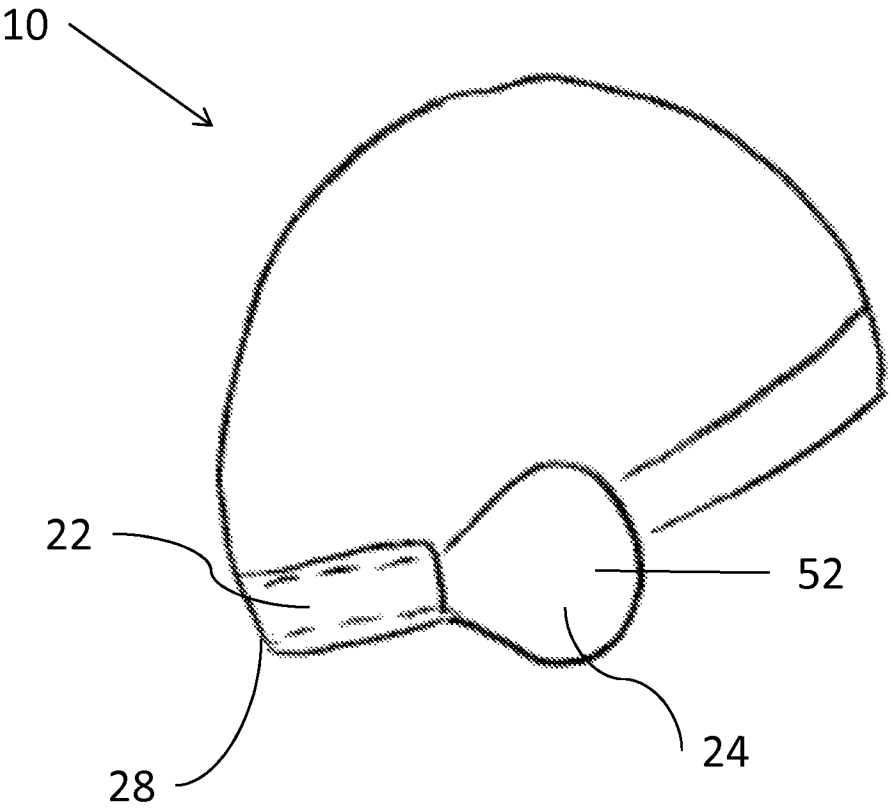
FIG. 9*a* is a cut-away view of the inside of the hat of the present invention showing the sleeve encasing the band of the ear warmer.
Figure 9B:
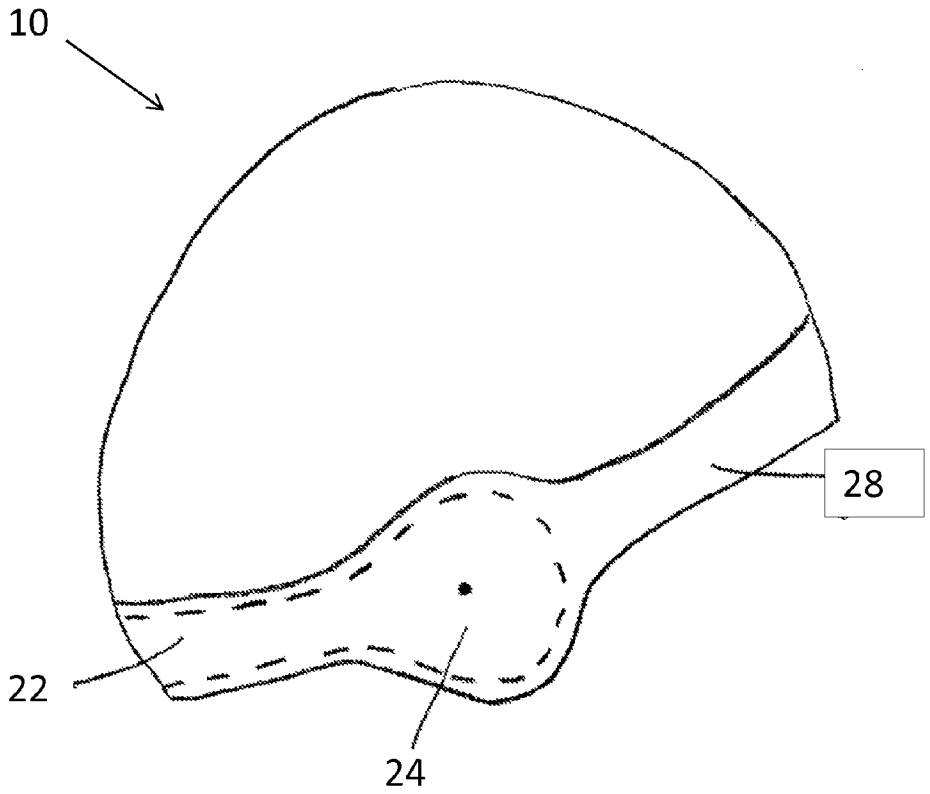
FIG. 9*b* is a cut-away view of the inside of the hat of the present invention showing the sleeve encasing the band and ear portions of the ear warmer.
Figure 10:
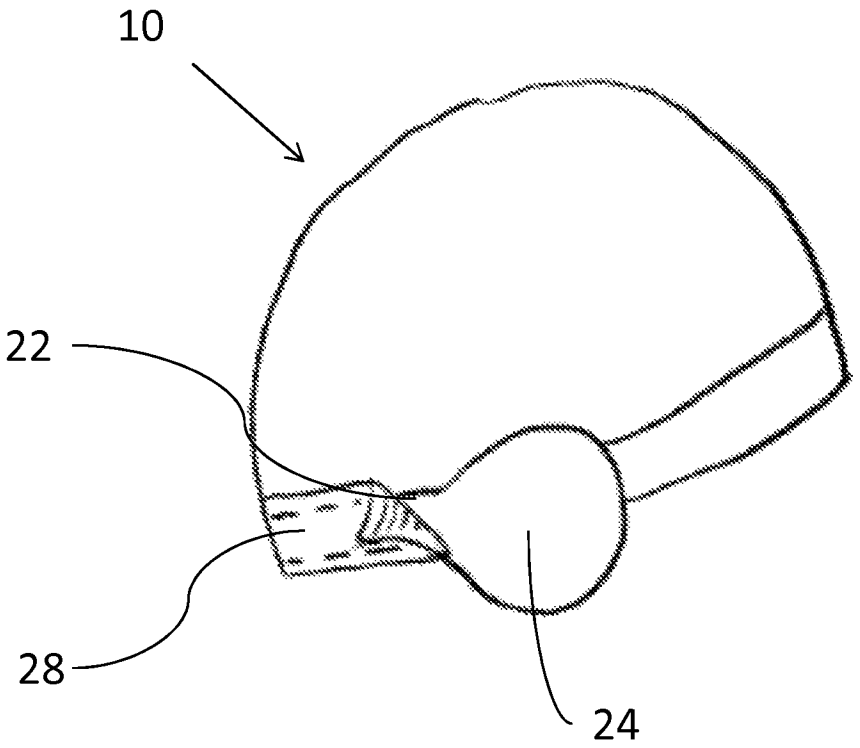
FIG. 10 is a cut-away view of the inside of the hat of the present invention showing the sleeve as it is being secured around the band of the ear warmer.

In one embodiment, as further seen in FIGS. 9*a*, 9*b*, and 10, the ear warmer band 22 is sewn into the sleeve 28 of the hat 10. The first and second ear portions are not encased in the sleeve, and contact the wearer's ear directly. The hat 10 having ear warmers is provided with extra tension that causes the hat to hug the head, particularly at the bottom back of the hat, and the ear warmers to snuggly cover the ears. In another embodiment shown in FIG. 9*b* the entire ear warmer 20 is encased in the sleeve, including the first and second ear portions. In one embodiment, the sleeve terminates after the ear portions. In a second embodiment, the sleeve is continuous around the bottom edge of the hat. A tack 24 passes through the ear portions and both layers of material, securing the ear portion to the desired location in the sleeve. The tack is typically made of thread, but can be other materials such as hard plastic or metal.

Figure 4:
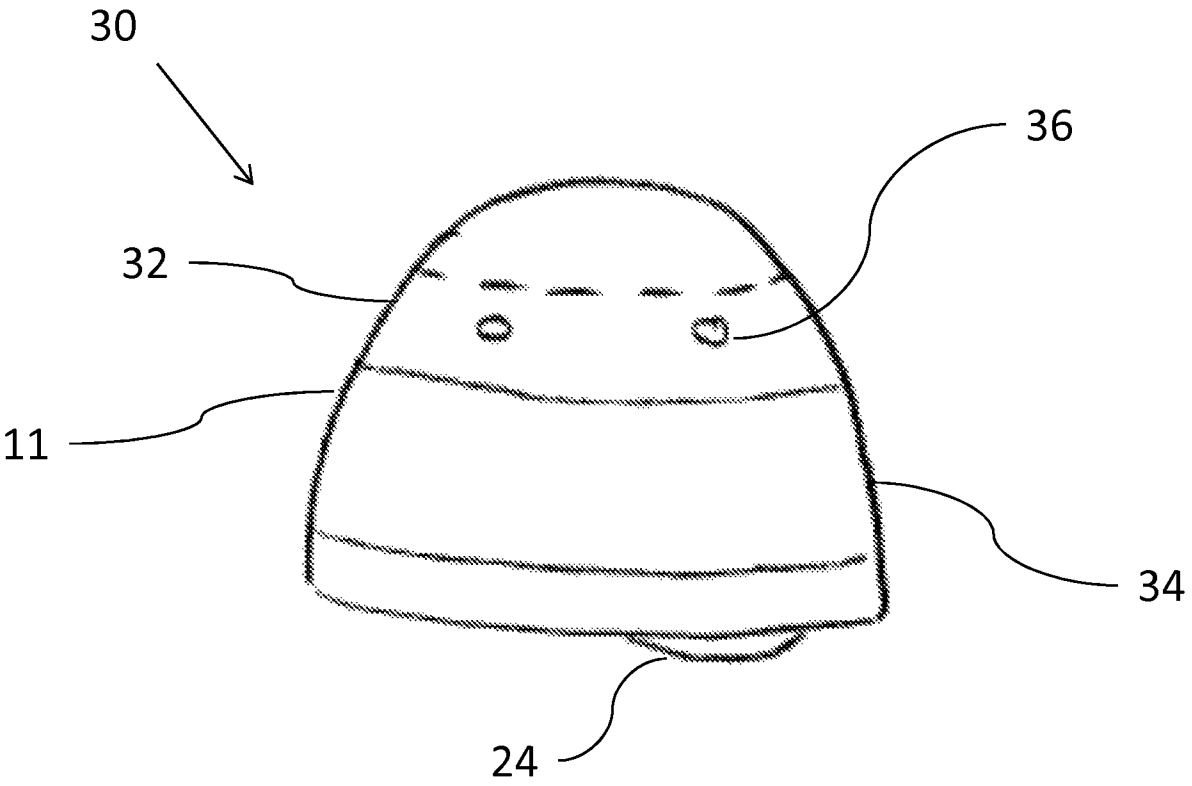
FIG. 4 is a side schematic view of a second exemplary embodiment of the hat of the present invention, wherein the hat has a top portion engaged with a bottom portion.
Figure 5:
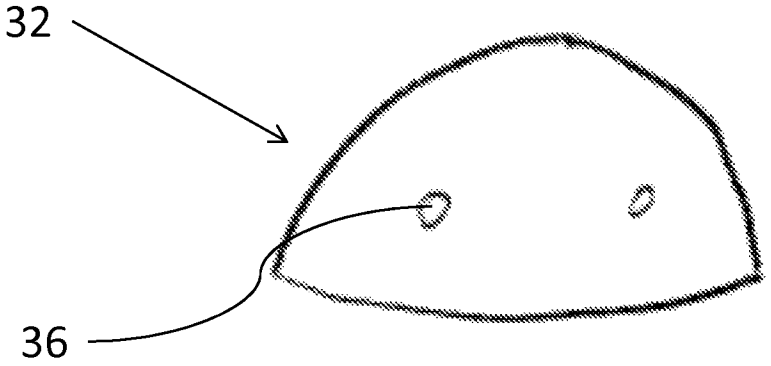
FIG. 5 is side schematic view of the top portion of the second exemplary embodiment of the hat of the present invention.
Figure 6:
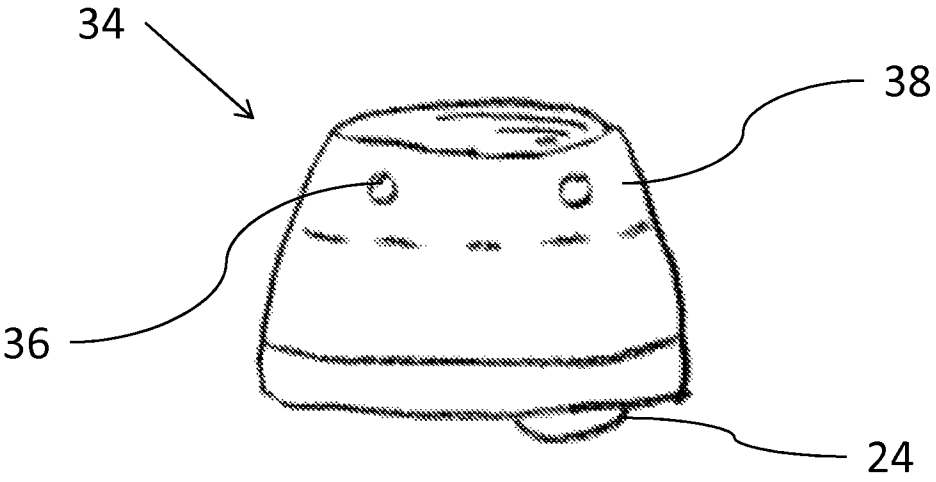
FIG. 6 is a side schematic view of the bottom portion of the second exemplary embodiment of the hat of the present invention.

In FIGS. 4, 5 and 6 a second embodiment of the present invention is illustrated. In FIG. 4, a hat 30 has a top portion 34, a bottom portion 36 releasably engaged by the means of engagement 36. The top portion 34, as shown in FIG. 5, can be removed or exchanged with various top portions 34 that could have various colors, designs or emblems. The bottom portion 36, as shown in FIG. 6, can be worn as a headband, with the cuff 38 optionally turned down. The releasable means of engagement 36 can be any suitable means of engagement, including buttons and button holes, snaps, hook and loop fastener, etc. The ear warmer 20 is attached to the bottom back of the bottom portion 36, in a manner similar to that shown in FIGS. 9*a*, 9*b* and 10.

Figure 3:
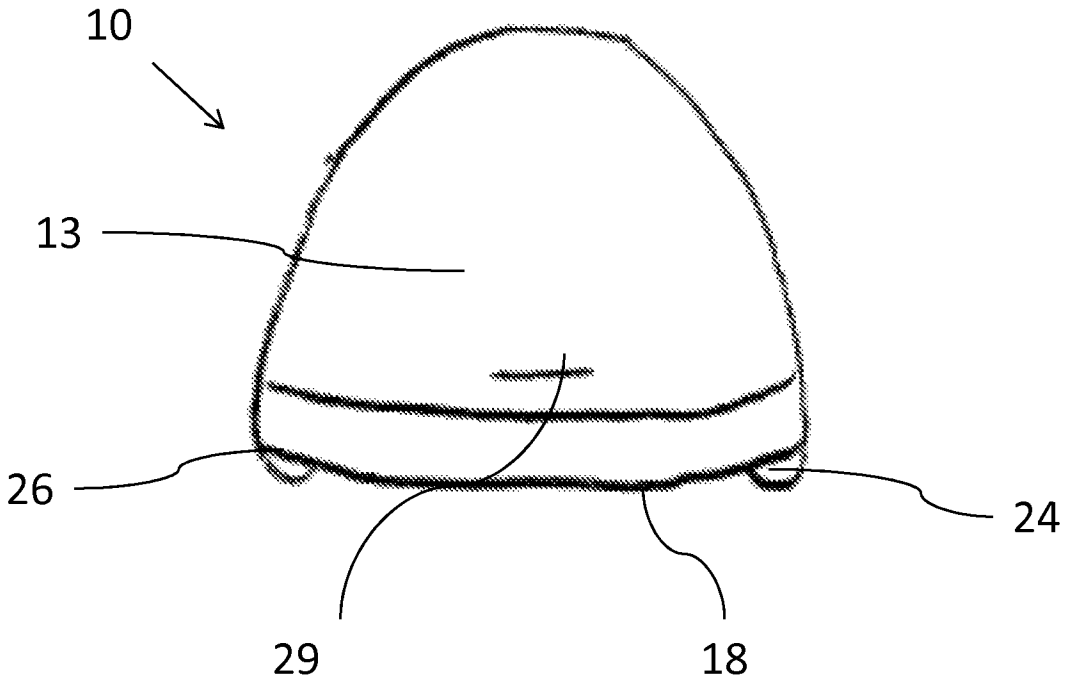
FIG. 3 is a rear schematic view of a second exemplary embodiment of a hat of the present invention.

Optional embodiments of the invention are shown in FIG. 3, which include a slit 29 opening in the back of the hat 10 that allows a low ponytail to extend through the hat. The slit involves an inner layer and an outer layer of the knit hat. The slits are offset about 0.25 inch, so that a direct channel is not formed, allowing cold air under the hat and onto the wearer's head. The slits are from about 1 to 3 inches wide and are typically horizontal.

Figure 11:
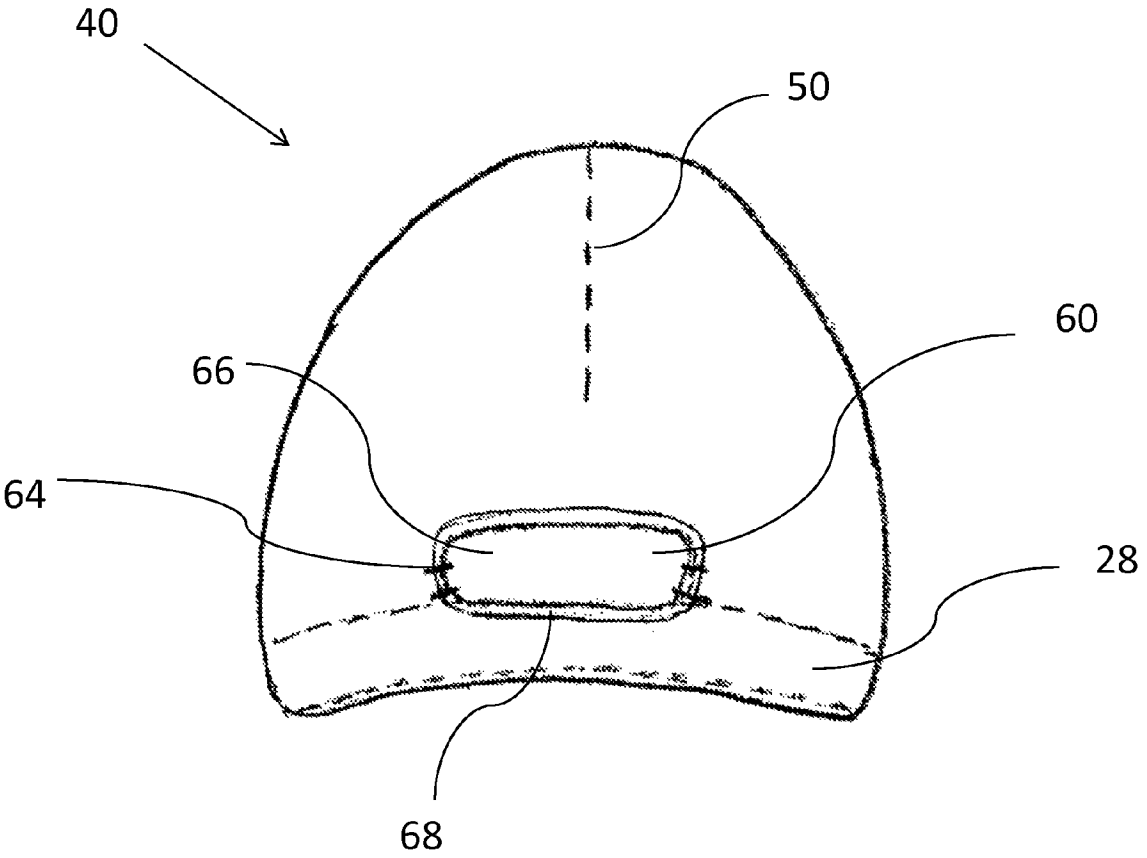
FIG. 11 is a cut-away view of the inside of the back of the hat of the present invention showing the optional Bluetooth wireless accessory pocket.
Figure 12:
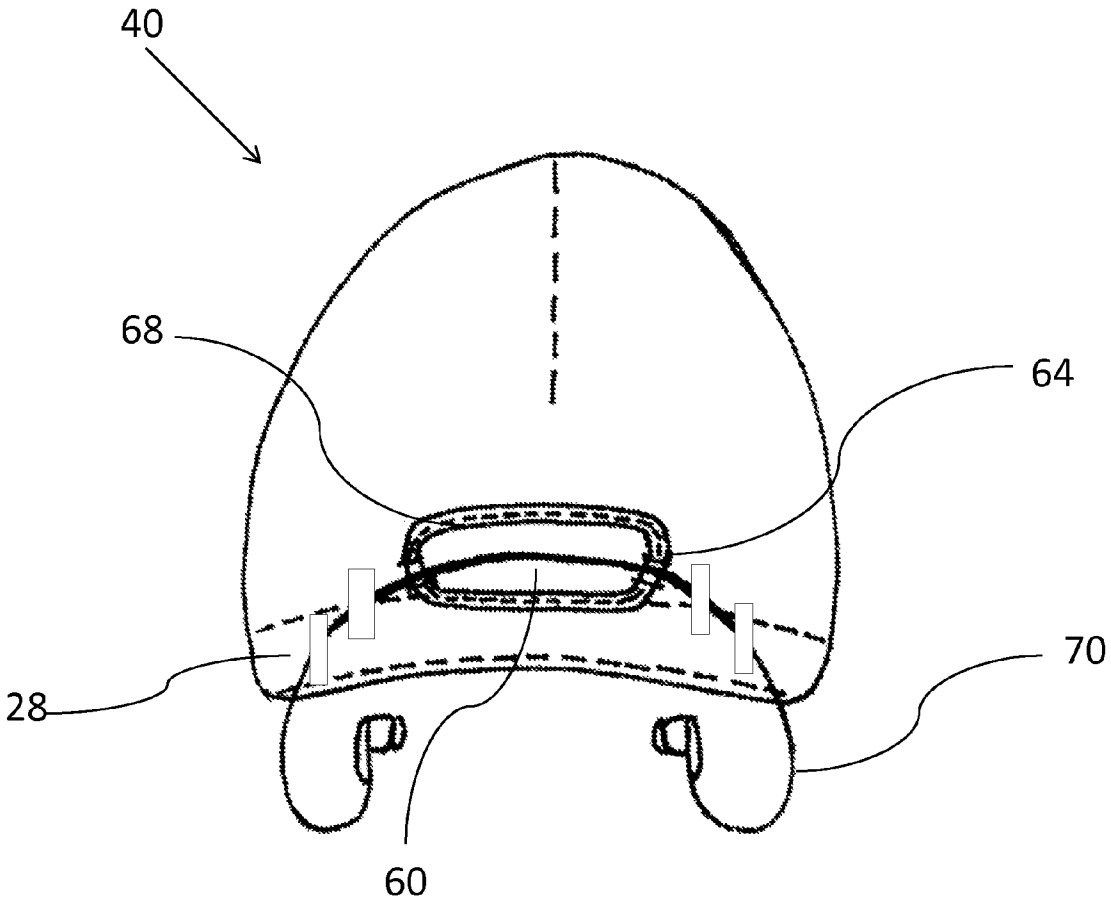
FIG. 12 is a cut-away view of the inside of the back of the hat of the present invention showing the optional Bluetooth wireless accessory pocket with the Bluetooth cord threaded through the pocket.

FIGS. 11 and 12 are directed to an optional interior pocket for use with a Bluetooth device. FIGS. 11 and 12 are cutaway views of the inside of the back of hat 40. The hat 40 has a center seam 50 and a sleeve 28. Optionally, the hat 40 has a pocket 60 sewn into the hat 40, positioned just above the sleeve 28. The pocket is formed by sewing a piece of elastic material 66, such as the hat is made of, for example, fleece, to the inside of the back of hat 40. The preferred size of the material 66 is from 1 to 5 inches wide and from 1 to 3 inches high. More preferably, the material 66 is from 2 to 4 inches wide and from 1 to 2 inches high. Optionally, the material 66 has an elastic edging 68 sewn around its perimeter. The pocket 60 has two openings 64, approximately opposite each other on the edge of the material 66 of sufficient size to admit the Bluetooth wireless accessory 70 to be threaded through the openings, into the pocket, then out of the pocket. Preferably, the openings 64 are from ½ to 1½ inches wide. The threaded accessory 70 is held in place by the pocket and is readily available to the user of hat 40.

Figure 13:
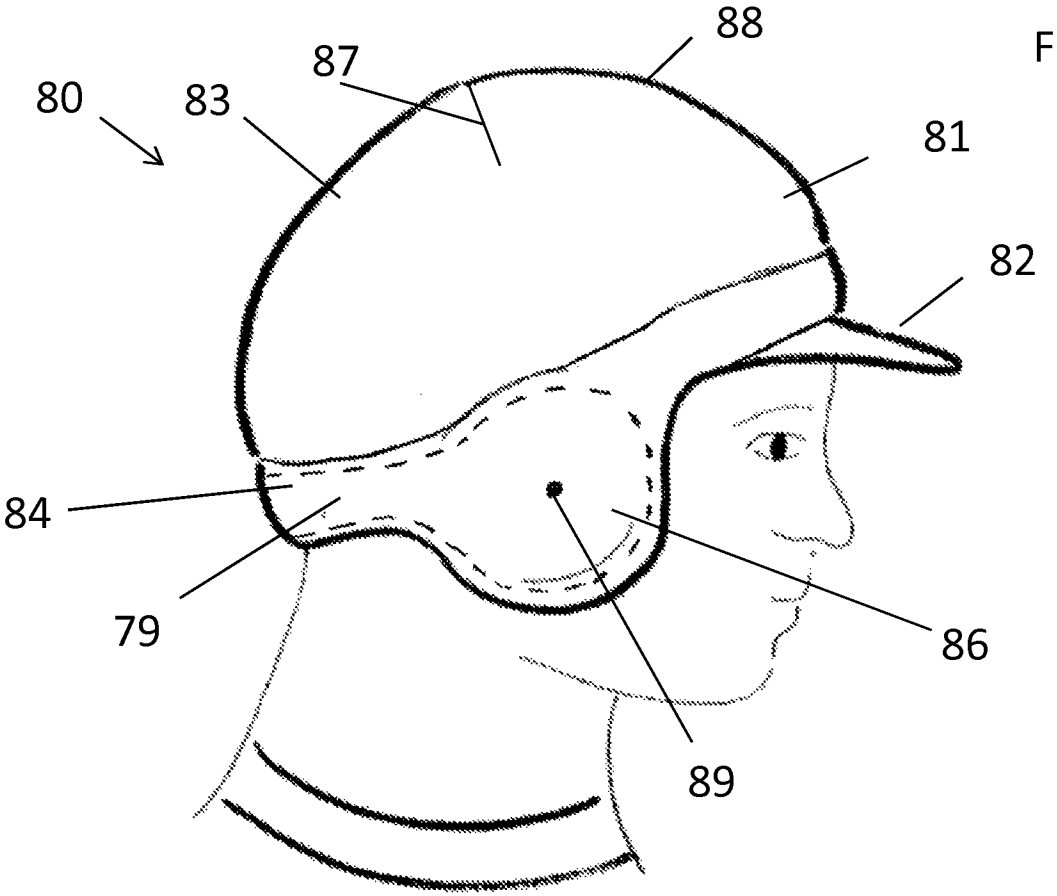
FIG. 13 is a side schematic view of a wearer using a third exemplary embodiment of the hat of the present invention.
Figure 14:
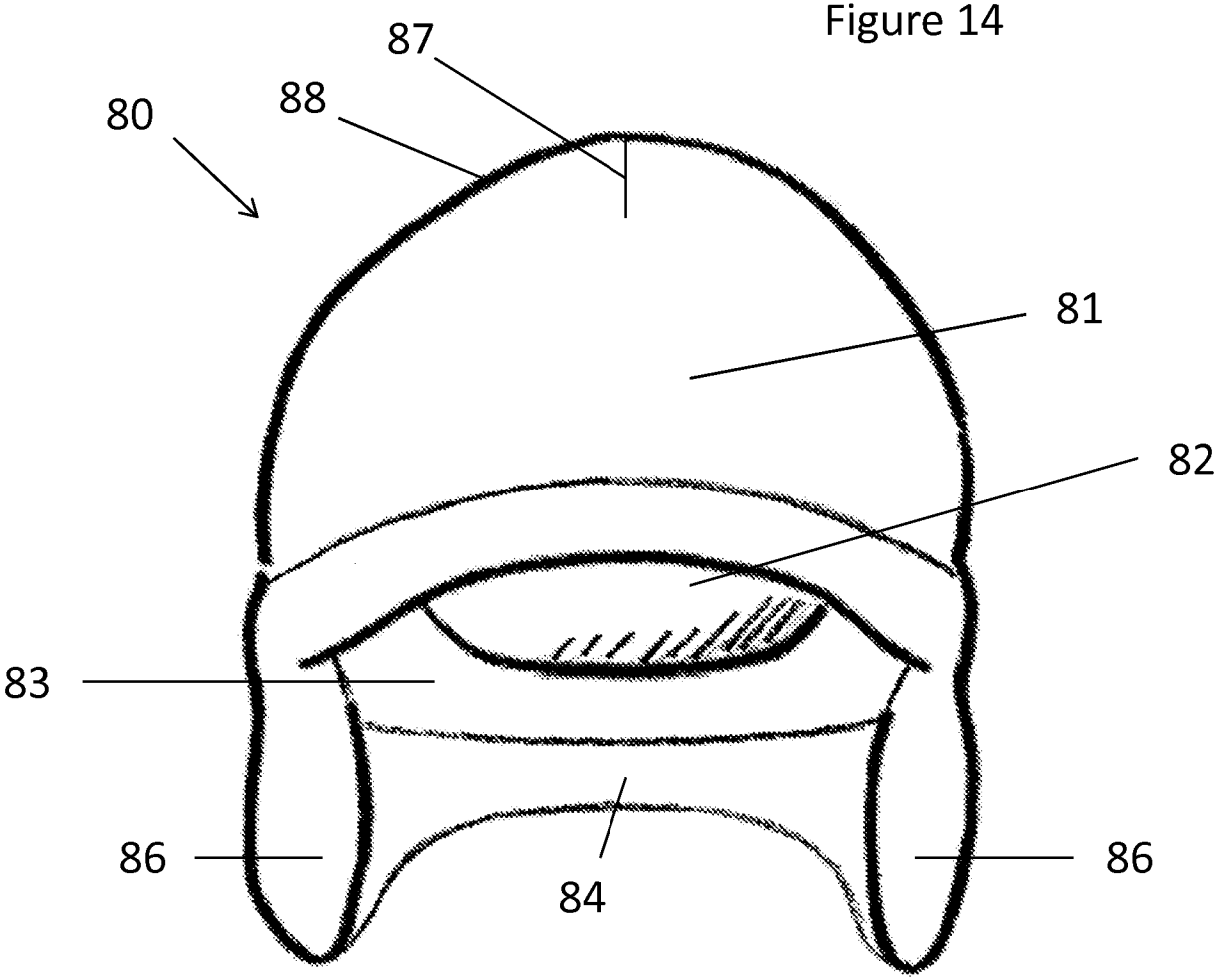
FIG. 14 is a front schematic view of the third exemplary embodiment of the hat of the present invention.
Figure 15:
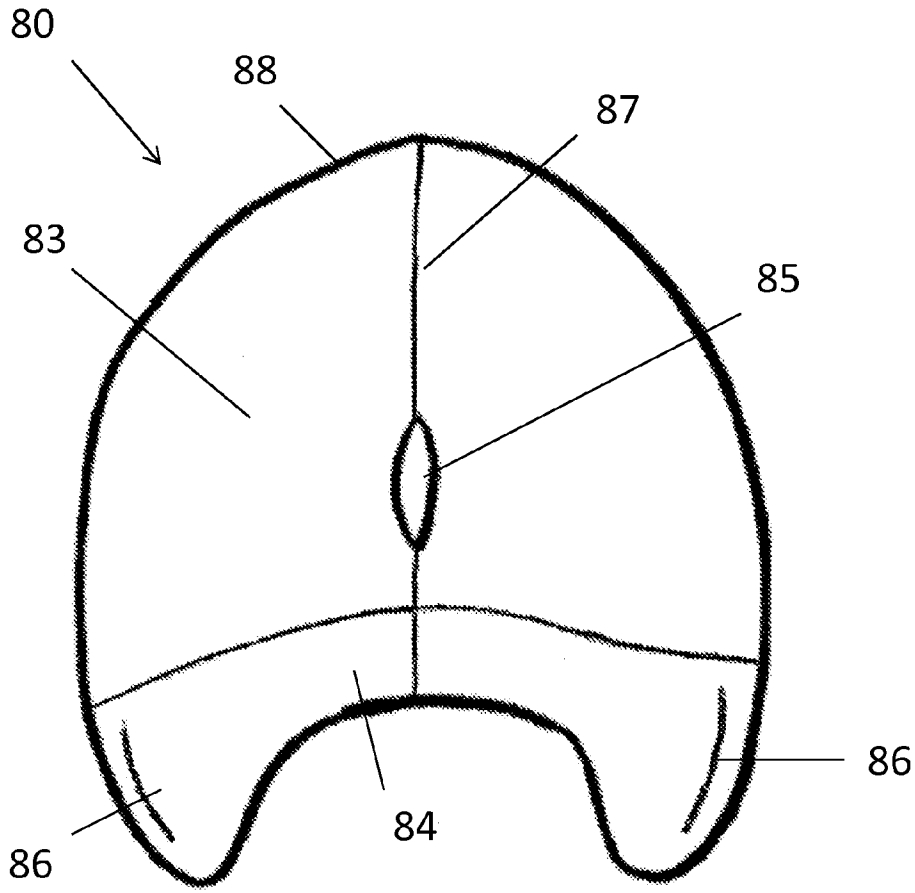
FIG. 15 is a back schematic view of the third exemplary embodiment of the hat of the present invention.

FIGS. 13, 14 and 15 show a third embodiment of the present invention, wherein the hat 80 has a bill or visor 82 on the front 81 of the hat. All of the embodiments of the present invention may include a bill or visor. At the top 88 of the hat is a seam 87 extending partially down the hat. At the back 83 of the hat and around the edge of the hat is a sleeve 84 encompassing an ear warmer band 79 and ear portions 86. Centered in the ear portion 86 is a tack 89 which passes through the ear portion and both layers of sleeve material, anchoring the ear portion in the desired location in the sleeve. Shown in FIG. 15 is a ponytail opening 85 which allows the wearer to thread his ponytail through the opening thereby providing a snug fit of the hat 80 against the wearer's head, even if the wearer has long hair.

Figure 16:
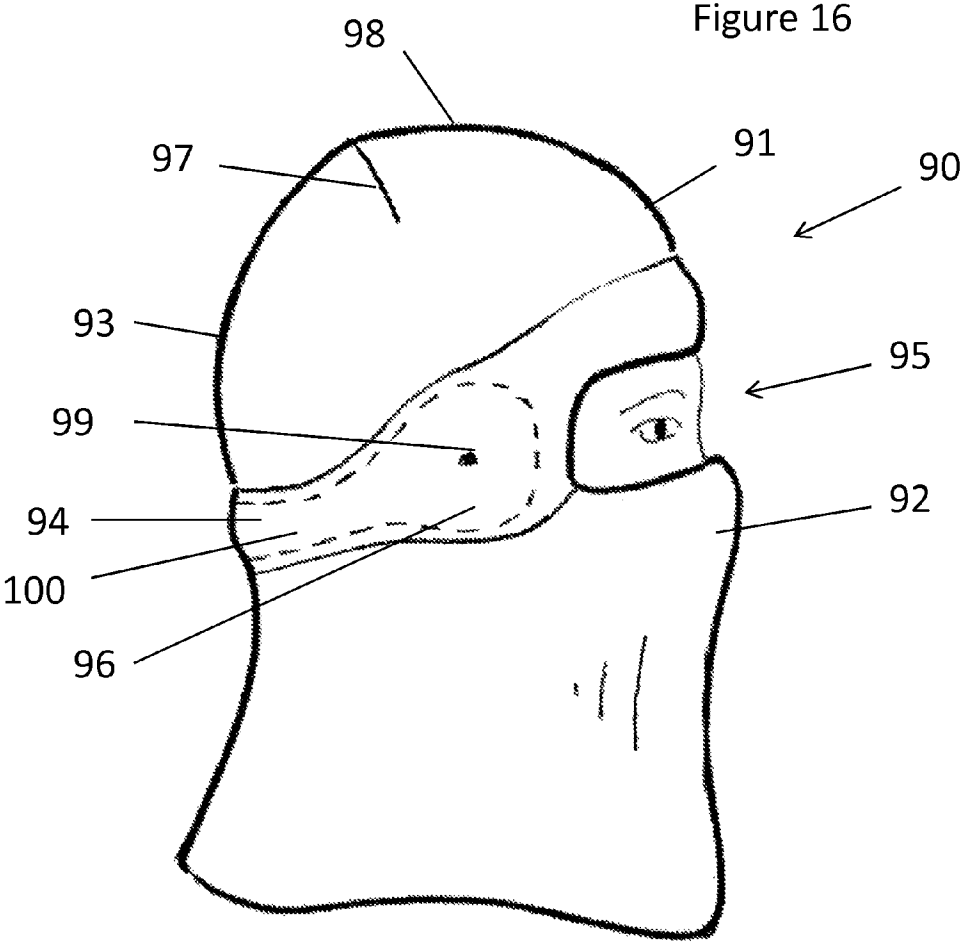
FIG. 16 is a side schematic view of a wearer using a fourth exemplary embodiment of the hat of the present invention.
Figure 17:
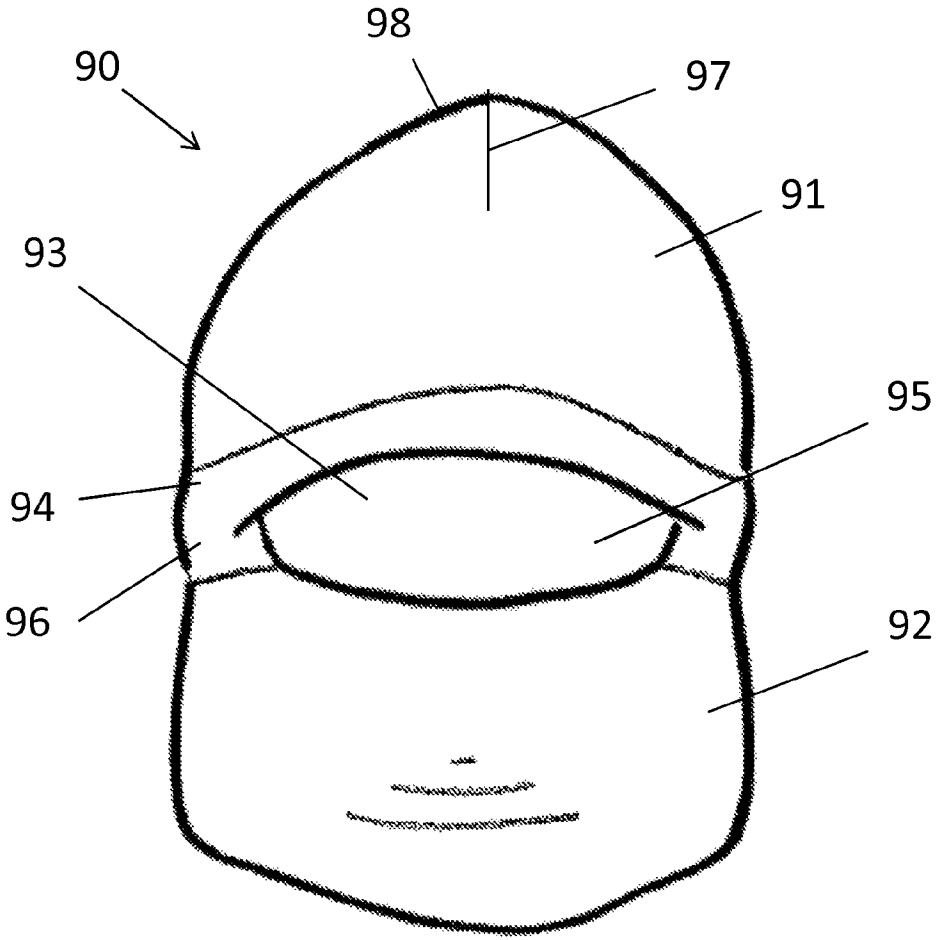
FIG. 17 is front schematic view the fourth exemplary embodiment of the hat of the present invention.

FIGS. 16 and 17 show a fourth embodiment of the present invention, wherein the hat 90 has a face mask 92. The mask is sufficiently long to cover the chin and neck of the wearer. Typically, the mask if from about 4 to about 10 inches long in front. Further typically, the mask is longer in the back than the front. The hat has a front 91 with at least one eye opening 95 positioned between the front and the mask. If one eye opening is present, it is typically from about 4 to 6 inches wide. In one embodiment, the hat has two eye openings. In one embodiment the mask encircles the entire hat, including the back 93. In another embodiment, the mask only covers the front of the hat. In yet another embodiment, the mask has a mouth opening below the eye opening.

The hat has a sleeve 94 that at least partially encircles the hat and encases the ear warmer band 100 and the ear portions 96. In a preferred embodiment, the sleeve encircles the entire hat. The top of the hat 98 has at least one seam 97. In another embodiment, the center of the ear portion is a tack 99 that passes through the ear portion and both layers of material to anchor the ear portion in the desired position in the sleeve.

Further optionally, the side of the hat may have slits for the temples of sunglasses or eyeglasses.

Further optionally, the hat may be decorated with emblems, logos embroidery, or other decorations.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A hat comprising a top, a bottom, a back and a front, and on the bottom of the hat at the back is a sleeve, wherein inserted into the sleeve is an ear warmer frame having a band and a first and second ear portions, wherein the first and second ear portions firmly cover the ears of the wearer, wherein the band hugs the back of the head of the wearer, wherein the frame is biased inward and provides tension to the hat, and wherein the ears of the wearer are cupped by the ear portion of the frame.

2. The hat of claim 1, wherein the ear portion is curved toward the inner side of the ear portion.

3. The hat of claim 2, wherein the ear portion is configured to flex when the ear warmer is disposed on the head of a user.

4. The hat of claim 3, wherein at the back of the hat is an opening for a ponytail.

5. The hat of claim 4, wherein the sleeve covers the ear portion and is fastened in place using a tack which passes through the ear portions and both layers of sleeve material.

6. A hat comprising a top, a back, a front and a face mask, wherein the face mask is positioned at the front of the hat, wherein positioned between the front of the hat and the face mask is at least one eye opening, wherein at least partially encircling the hat is a sleeve, wherein inserted into the sleeve is an ear warmer frame having a band and a first and second ear portions, wherein the first and second ear portions firmly cover the ears of the wearer, wherein the band hugs the back of the head of the wearer, and wherein the frame is biased inward and provides tension to the hat.

7. The hat of claim 6, wherein the ears of the wearer are cupped by the ear portion of the frame and wherein the ear portion is curved toward the inner side of the ear portion.

8. The hat of claim 7, wherein the face mask encircles the hat.

9. The hat of claim 8, wherein the ear portion is configured to flex when the ear warmer is disposed on the head of a user.

10. The hat of claim 9, wherein the sleeve totally encircles the hat.

11. The hat of claim 10, wherein the sleeve covers the ear portion and is fastened in place using a tack which passes through the ear portions and both layers of sleeve material.

12. The hat of claim 1 further comprising a bill.

13. The hat of claim 6 further comprising a bill.

14. The hat of claim 1 further comprising a thread yarn material suitable for protection from cold air; and a construction pattern for the yarn that stretches and contracts upon application and release; and a shape suitable for securing the hat around a person's head so as to conform to the contours of the head to substantially minimize gaps between the hat and the head.

15. The hat of claim 6 further comprising a thread yarn material suitable for protection from cold air; and a construction pattern for the yarn that stretches and contracts upon application and release; and a shape suitable for securing the hat around a person's head so as to conform to the contours of the head to substantially minimize gaps between the hat and the head.

16. A hat comprising a top portion and a bottom portion which releasably engage, wherein the bottom portion has a front and a back, and on the bottom of the hat at the back is a sleeve, wherein inserted into the sleeve is ear warmer frame having a band having a first and second ear portions, wherein the band provides tension to the hat when worn so that it hugs the back of the head, and wherein the first and second ear portions firmly cover the ears of the wearer, wherein the band hugs the back of the head of the wearer, wherein the frame is biased inward and provides tension to the hat, and wherein the ears of the wearer are cupped by the ear portion of the frame.

17. The hat of claim 16, wherein the ear portion is curved toward the inner side of the ear portion.

18. The hat of claim 17, wherein the ear portion is configured to flex when the ear warmer is disposed on the head of a user.

* * * * *